US005739444A

United States Patent [19]

Borisoff

[11] Patent Number: 5,739,444

[45] Date of Patent: Apr. 14, 1998

[54] MULTI-TUNER BRIDGE FOR STRINGED MUSICAL INSTRUMENTS

[76] Inventor: David J. Borisoff, P.O. Box 117, Romulus, N.Y. 14541

[21] Appl. No.: 625,040

[22] Filed: Mar. 29, 1996

Related U.S. Application Data

[62] Division of Ser. No. 173,139, Dec. 22, 1993, Pat. No. 5,542,330, which is a continuation of Ser. No. 820,280, Jan. 14, 1992, abandoned.

[51] Int. Cl.[6] ..... G10D 1/08

[52] U.S. Cl. ..... 84/291; 84/267

[58] Field of Search ..... 84/291, 267, 297 R, 84/298, 307, 309, 299

[56] References Cited

U.S. PATENT DOCUMENTS 4,793,233 12/1988 Borisoff ..... 84/299

*Primary Examiner*—Cassandra C. Spyrou

*Attorney, Agent, or Firm*—Oppenheimer Poms Smith

[57] ABSTRACT

A bridge device is provided for a stringed musical instrument having a body, a neck extending from the body, and a set of tensioned strings extending along the neck and over at least a portion of the body. The bridge device comprises a bridge plate mounted adjacent a front surface of the body, a plurality of saddles secured to the bridge plate, and a plurality of armatures pivotably secured to the bridge plate. The saddles are individually adjustable to vary the effective length of each of the strings and to vary the distance between each of the strings and the bridge plate. Each of the armatures individually engage the strings and are selectively manipulable to change the tension of each of the strings between one of three predetermined tension levels.

2 Claims, 3 Drawing Sheets

FIG. 10
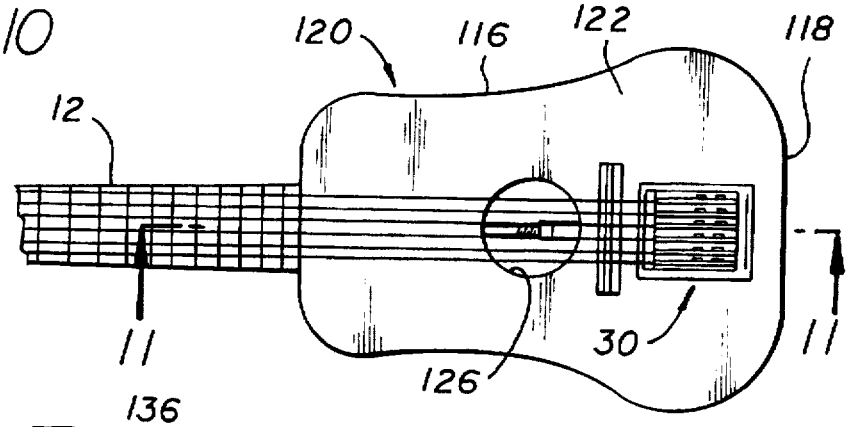
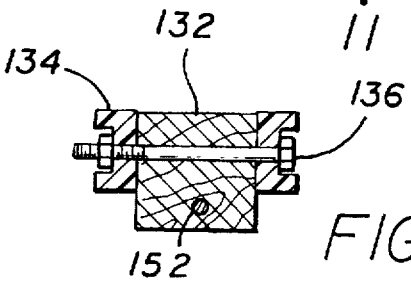
FIG. 13
FIG. 11
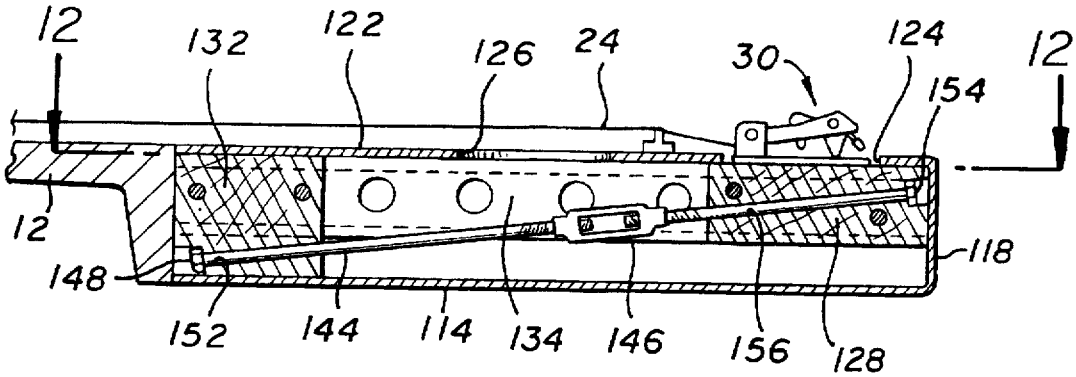
FIG. 12
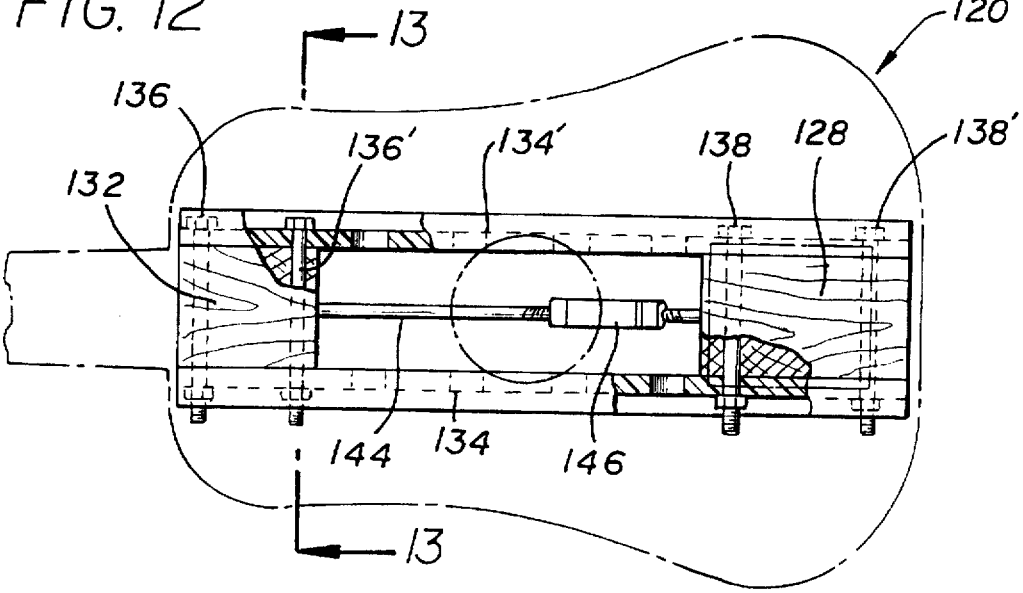

MULTI-TUNER BRIDGE FOR STRINGED MUSICAL INSTRUMENTS

CROSS REFERENCE TO RELATED APPLICATIONS

This application is a divisional of 08/173,139 filed Dec. 22, 1993, now U.S. Pat. No. 5,542,330 which is a continuation of Ser No. 07/820,280 filed Jan. 14, 1992, now abandoned.

BACKGROUND OF THE INVENTION

1. Field of the Invention

The present invention relates to the tuning of musical instruments, and more particularly to a multi-tuner bridge for a stringed musical instrument in which each of the strings can be instantly retuned to one of three preset positions.

2. Description of the Related Art

Stringed musical instruments, such as guitars, are widely enjoyed by both musicians and music lovers alike, due to the wide range of sounds which they can produce. This musical range stems from the fact that the instruments have a plurality of strings, each of which can be tuned to produce a distinct musical note. The note produced by the strings is dependent upon the thickness of the string, the intonation, or effective length of the string, and the tension of the string. Most stringed instruments are equipped with tuning pegs at an end of the strings, which can be adjusted to vary the tension on the strings, and a bridge fixed in place at the opposite end of the strings from the tuning pegs. The bridge defines an effective end to the length of the strings. As the tuning pegs are tightened, the frequency produced by the vibrating string is increased, raising the pitch of the note. Once the instrument has been tuned by adjusting the tuning pegs to the proper settings, the instrument cannot be retuned to new settings without readjusting the tuning pegs.

It is very common for musicians performing on stage to require their instruments to be tuned to different settings, or keys, to accommodate the playing of different songs. Since the musician cannot just stop the performance and retune the instrument, it is common for the musician to have numerous instruments, each of which are tuned to a different key or setting. This presents obvious problems to the musician, in that several instruments may be required, and that it is quite cumbersome to change instruments mid-performance.

Devices for musical instruments which alter the tension of the guitar strings are known in the prior art. One such prior art string tension varying device is commonly known as a "tremolo" bridge. The tremolo bridge comprises a handle which extends from the bridge plate on the body of the guitar. By pulling back on the handle, the musician increases the tension on each of the strings, which has the effect of increasing the pitch of the strings. Conversely, by pushing down on the handle, the string tension decreases which decreases the pitch. However, a drawback with the tremolo bridge is that the strings are not retuned to a fixed position. Instead, the strings are temporarily stretched or loosened, and they return to their tuned position once the musician lets go of the handle.

An improved solution to this problem was provided in the prior art by U.S. Pat. No. 4,535,670, issued Aug. 20, 1985, by Borisoff, the inventor in this case. The prior art device discloses an attachment for a stringed musical instrument having an actuator arm which can be manipulated by the musician to precisely change the pitch of the strings. The actuator arm is pivotally connected to a rocker arm, which in turn engages an end of the string. The rocker arm can pivot relative the instrument body to increase or decrease the tension of the string. By manipulating the actuator arm, an operator can change the tension on the string from a first tension to a second tension. The musician can set the string to a first pitch by adjusting the associated tuning peg, and to a second pitch by adjusting a tuning screw associated with an end of the rocker arm. However, this prior art device is quite limited, in that it only enables the selection between two preset tuning positions, and does not allow for the adjustment of intonation.

In addition, the prior art device cannot be readily adapted for use in an acoustic instrument, such as an acoustic guitar. An acoustic guitar has a generally hollow body. The front or facing surface of the body is known as the soundboard, and the strings generally terminate at a bridge affixed to a portion of the soundboard. The amplification of the vibrating strings is provided by the resonance of the soundboard in association with the cavity defined by the hollow body. Accordingly, external devices, such as the prior art device, cannot be affixed to the soundboard without significantly altering its acoustic characteristics. Additionally, the lightweight materials often used in acoustic instruments could potentially be damaged by the stress induced by the altering tension of the strings.

An additional problem with adapting the prior art device to an acoustic guitar is that of "cabinet drop." As the tension on individual strings is increased or decreased, the acoustic guitar body can bow or warp due to the increased string tension. The resulting change in shape of the guitar body directly affects the tension of the strings adjacent to the ones being retuned. Thus, as one string is tightened the adjacent strings become loosened, and as the string is loosened the adjacent strings become tightened. This change to the adjacent string tension is known as "cabinet drop."

Thus, it would be desirable to provide a bridge for a stringed instrument capable of providing the musician with three preset tuning positions per string. It would be further desirable to provide a bridge for a stringed musical instrument capable of permitting variations in intonation. It would be further desirable to provide a bridge for an acoustic musical instrument having a hollow body, capable of providing a musician with instant access to three preset tuning positions per string. It would be still further desirable to provide a mechanism for structurally reinforcing an acoustic guitar without altering the acoustic characteristics of the soundboard to prevent structural damage to the instrument or cabinet drop.

SUMMARY OF THE INVENTION

Accordingly, a principal object of the present invention is to provide a multi-tuner bridge for a string musical instrument capable of providing the musician with instant access to three preset tuning positions per string.

Another object of the present invention is to provide a bridge capable of permitting variations in intonation.

Still another object of the present invention is to provide a bridge for an acoustic guitar having a hollow body, providing the musician with the capability of three preset tuning positions per string.

Yet another object of the present invention is to provide structural reinforcement to an acoustic guitar while reducing the soundboard bracing, to improve the acoustic quality of the guitar while enabling it to operate with externally mounted string tension varying devices.

Yet another object of the present invention is to provide structural reinforcement to an acoustic guitar to prevent cabinet drop when the tension of individual strings is varied.

To achieve the foregoing objects and in accordance with the purpose of this invention, the bridge device for a stringed musical instrument having a body, a neck extending from the body, and a set of tensioned strings extending along the neck and over at least a portion of the body, comprises a bridge plate mounted adjacent a front surface of the body, a plurality of saddles secured to the bridge plate, each of the saddles being individually adjustable to vary the effective length of each of the strings and to vary the distance between each of the strings and the bridge plate, and a plurality of armatures pivotally secured to the bridge plate, each of the armatures individually engaging the strings and being selectively manipulable to change the tension of each of the strings between one of three predetermined tension levels.

In accordance with an alternative embodiment of the present invention, the bridge device for a stringed musical instrument having a hollow body, a neck extending from the body, and a set of tensioned strings extending along the neck and over at least a portion of the body, comprises a support block provided in an interior portion of the body and partially extending through an opening in a front surface of the body, a bridge plate affixed to an exposed surface of the support block, and a mechanism for mounting the support block within the interior portion.

A more complete understanding of the multi-tuner bridge of the present invention will be afforded to those skilled in the art, as well as a realization of additional advantages and objects thereof by a consideration of the following detailed description of the preferred embodiment. Reference will be made to the appended sheets of drawings which will be first described briefly.

BRIEF DESCRIPTION OF THE DRAWINGS

FIG. 10 is a cross-sectional view of the acoustic guitar, as taken through the section 10—10 of FIG. 9;

FIG. 11 is a partial cutaway view of an acoustic guitar showing the interior portion;

FIG. 12 is a cross-sectional view of the forward mounting block placed in the interior portion of the acoustic guitar, as taken through the section 12—12 of FIG. 11;

FIG. 13 is a cross-sectional view taken from FIG. 12.

DESCRIPTION OF THE PREFERRED EMBODIMENTS

Figure 1:
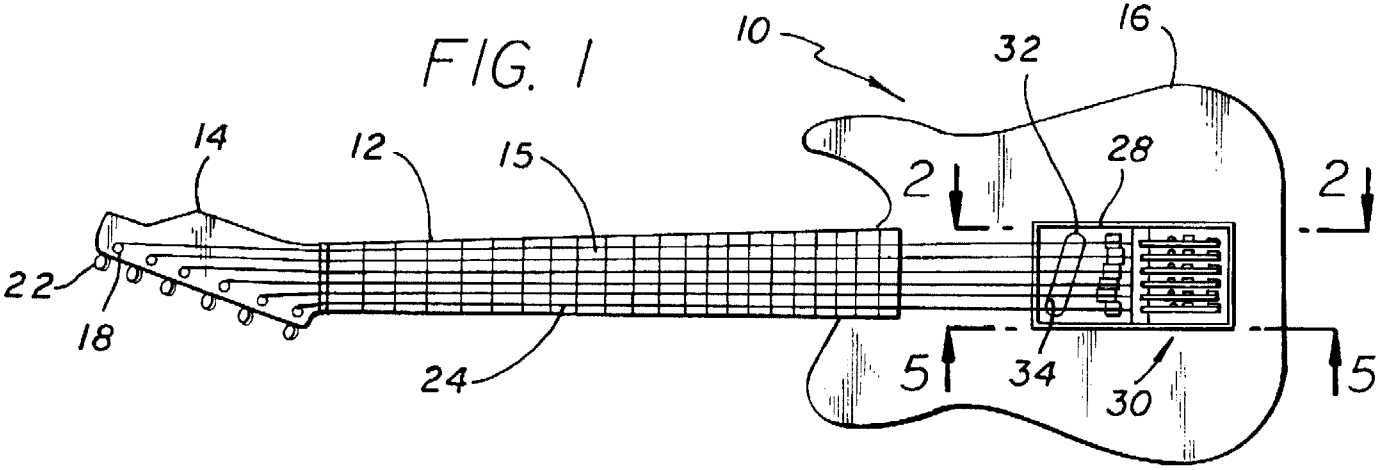
FIG. 1 shows a front view of the guitar showing a plurality of tensioned strings and a multi-tuner bridge of the present invention.

Musicians have a need to be able to accurately and rapidly change the tune of each of the strings of a musical instrument, such as a guitar. An exemplary guitar 10 is shown in FIG. 1. The guitar 10 is an electric guitar, having a solid body 16, a neck 12 extending from the body, and a head 14 disposed at the end of the neck. The head 14 has a plurality of tuning pegs 18 which can selectively increase or decrease the tension placed on the strings 24. As commonly known in the art, an end of the string. 24 winds around the tuning peg 18, and the string is pulled tight across the neck 12 and body. 16 by continued rotation of the tuning peg. On the front surface of neck 12, a fingerboard 15 is attached, which has individual frets, or finger positions (not shown). The musician presses the strings against the fingerboard to sound individual notes. Generally centered on body 16 is a bridge plate 28 which supports the multi-tuner bridge of the present invention, shown generally at 30. Exposed through the bridge plate 28 which is mounted to body 16, is the guitar pickup 32. As commonly known in the art, the pickups receive sounds generated by the vibrating guitar strings 24 and converts them into electrical signals which can be externally amplified. Accordingly, the bridge plate 28 has an associated cavity 34 which is sized to enable the pickup 32 to fully extend through it.

Figure 2:
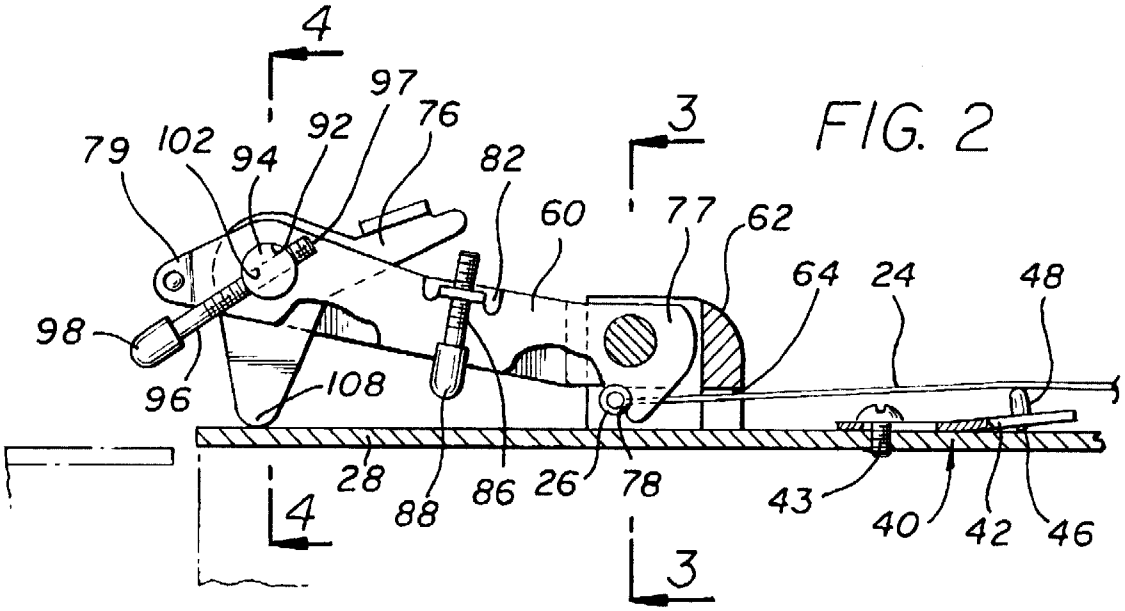
FIG. 2 shows an armature portion of the multi-tuner bridge, as taken through the section 2—2 of FIG. 1.
Figure 3:
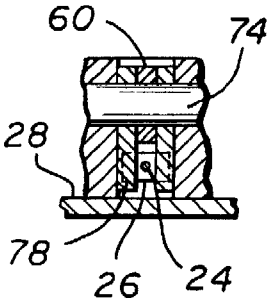
FIG. 3 a cross-sectional view of a forward axle of the armature of FIG. 2, as taken through the section 3—3 of FIG. 2.
Figure 4:
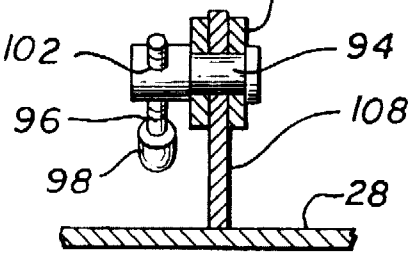
FIG. 4 shows a cross-sectional view of the armature and the first adjustment screw, as taken through the section 4—4 of FIG. 2.

Referring next to FIGS. 2 and 3, it is shown that the guitar string 24 has a ball 26 secured at an end of the string. The ball 26 is commonly known in the art, and enables the string to be threaded through an aperture of a bridge and held secure in the bridge. In the present invention, the ball 26 engages a hook 78 provided at a fulcrum end of lever arm 100, which will be fully described below. If this string needs to be replaced, it is simply a matter of removing the old string by undoing the string ends coiled onto the tuning pegs 18, and threading a new string 24 into its place with the ball 26 engaging the hook 78.

Figure 8:
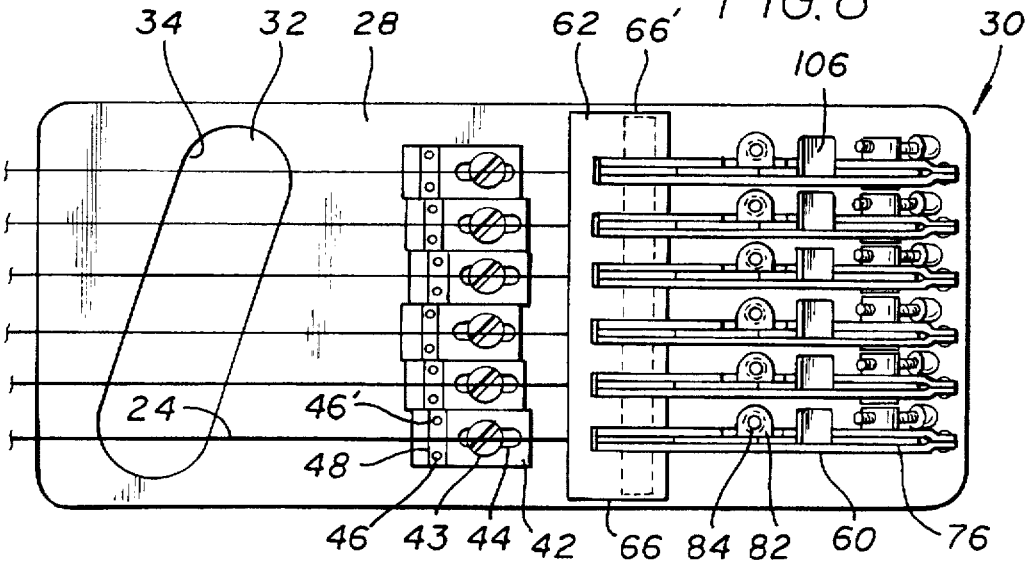
FIG. 8 is a front view of the multi-tuner bridge of the present invention in greater detail, as taken through the section 8—8 of FIG. 6.

As the string 24 travels across the body 16 and the bridge plate 28, it engages a saddle, shown generally at 40 of FIG. 2. The saddle 40 comprises a leaf portion 42 and a shelf portion 48. The leaf portion 42 is substantially flat and thin, and is formed from a flexible material, such as Delrin™. The leaf portion 42 further has an elongated mounting hole 44, which is best shown in FIG. 8. The elongated mounting hole 44 permits the saddle 40 to be secured to bridge plate 28 in an assortment of positions. Although an exemplary clamping screw 43 secures the saddle 40 to the bridge plate 28, it is anticipated that other clamping devices utilizing bolts, clips or pins be used.

The shelf 48 engages the string 26, creating an effective end to the string. It should be apparent to those skilled in the art that vibration of the string caused by plucking or strumming by a musician will not extend beyond the effective end point of the string; this is known as the "intonation" of the string. As the position of the saddle 40 is changed by manipulating the saddle in accordance with the elongated mounting hole 44 relative body 16, the effective length of string 24 is changed, which varies the intonation of the string. For example, if the saddle 40 is moved forward in the direction of the head 14, the effective length of the string 24 is reduced. It is anticipated that each of the strings 24 of the guitar 10 have a distinct saddle 40, which can be selectively adjusted to vary the intonation of each of the strings individually. This is best shown in FIG. 8 in which each of the individual saddles 40 are adjusted differently.

The securing or clamping of saddles 40 to guitar body 16 has a significant effect on the acoustic quality of the instrument. As the string 24 is plucked or strummed, it will vibrate forming the desired note. The duration of time with which the string 24 continues to vibrate is known as the "sustain." If the saddle 40, which forms the effective end of the string 24, is not secured, it will vibrate against the bridge plate 28 drawing energy away from the string and reducing its sustain. By clamping the saddle 40 to the bridge plate 28, the energy remains in the string 24, thus increasing the string's sustain.

Figure 9:
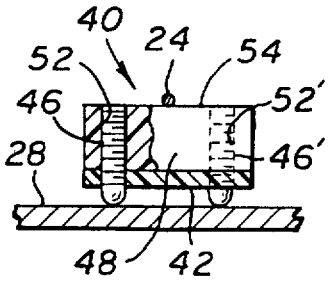
FIG. 9 is a front view of an acoustic guitar showing the multi-tuner bridge of the present invention.

The saddles 40 also enable the adjustment to the "action" of the strings 24. This action is the height of the strings above the neck 12. As shown in FIG. 9, each of the shelves 48 have a pair of threaded holes 52 and 52' extending from the string engaging surface through the bottom portion of leaf 42. The threaded holes 52 are sized to engage a corresponding pair of set screws 46 and 46'. By tightening each of the set screws 46 and 46', the screws engage the exposed surface of bridge plate 28, causing the leaf portions 42 to flex. By selectively tightening the set screws 46 and 46', the musician can alter the action of each of the individual strings 24. It is common in the art for the outermost strings to be adjusted closer to the surface of the neck 12, while the innermost strings are adjusted with a greater space between the neck and string 24. This form of adjusting results in a generally curved configuration of the strings 24 when observed by citing along the axis of the strings. The fingerboard 15 will generally have a curvature and the action of the strings will be adjusted to correspond with the fingerboard curvature. Moreover, each of the individual strings 24 have distinct diameters, which further affects the action adjustment of the saddles 40.

Referring next to FIGS. 5 through 8, there is shown a multi-tuner armature 60 in accordance with the present invention. FIG. 8 shows a plurality of the multi-tuner armatures 60 arranged in relation to the bridge plate 28, each associated with an individual one of the strings 24. Each of the armatures 60 have a fulcrum end 77, and a lever end 79, with the fulcrum ends of the armatures secured by a mounting comb 62. The mounting comb 62 further comprises an opening 64 for the passage of the strings 24, and a pair of sidewalls 66 and 66'. Each of the armatures 60 have a forward pivot opening 72 through which a common pivot pin 74 passes. As will be further described below, the lifting of the lever end 79 of the armature 60 causes the armature to pivot against the fulcrum formed by pivot pin 74, further increasing the tension placed upon the associated string 24.

Each of the armatures 60 can be adjusted to provide three distinct tuning positions, or tensions, for each associated string 24. To accomplish this, a plurality of lever arms 76 are provided which pivot rotationally from the lever end 79 of each of the armatures 60. The lever arms 76 have a handle portion 106 and a nose portion 108, which will be described below. The lever arms 76 pivot by use of axle 94 which is provided on the lever end 79 of armatures 60. The axle 94 further has a threaded hole 102 which extends through the diameter of the axle. A first tuning screw 96 engages the threaded hole 102 and can be adjusted to a tuned position, as will be described below. A hexagonal socket 97 is provided at an end of the tuning screw 96, which is shaped to be engaged by a hexagonal shaped wrench for adjustment of the screw position. A glide cap 98 is provided at an other end of the first tuning screw 96, which provides a cushion for contact between the tuning screw and the bridge plate 28. The armatures 60 further have a supporting tab 82 extending laterally from a side of an intermediate portion of the armature. The supporting tabs 82 also have a threaded portion 84 to engage a second tuning screw 86. The second tuning screw 86, is perpendicularly disposed with relation to the armature 60, and has a glide cap 88 disposed at an end.

Figure 5:
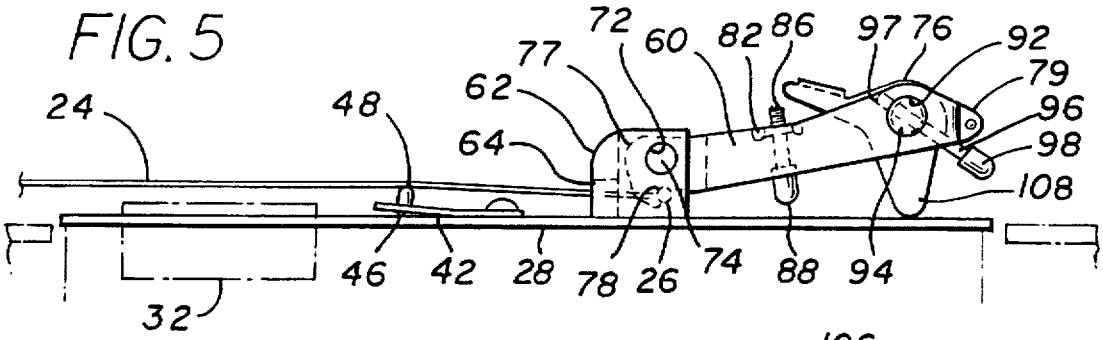
FIG 5 is a side view of the armature placed in the first fixed position.
Figure 6:
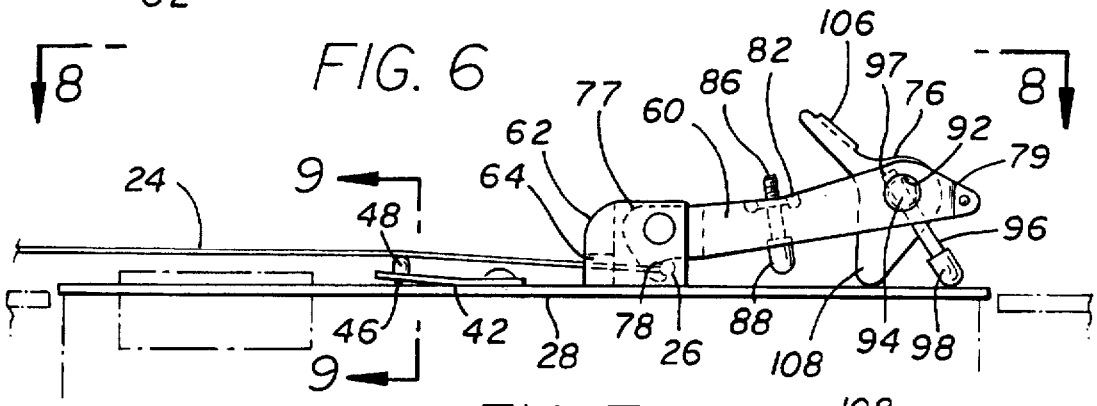
FIG. 6 is a side view of the armature placed in a second fixed position.

With the lever arm 76 in the position shown in FIG. 5, a first tension level is applied to the associated string 24. The nose portion 108 is positioned to abut the surface of the bridge plate 28 in order to maintain the angular position of armature 60 relative to the bridge plate 28. By lifting upwardly on the handle portion 104 of lever arm 76 relative armature 60, the lever arm can be manipulated to the position shown in FIG. 6. In this position, both the nose portion 108 and the glide cap 98 of the first tuning screw 96 contact the bridge plate 28. It should be apparent that by loosening the first tuning screw 96 relative the threaded hole 102 of axle 92, the tension placed on string 26 can be adjusted. As the first tuning screw 96 is loosened outwardly relative the axle 94, the contact point of nose portion 108 will vary and the overall direction of the armature 60 will approach that of bridge plate 28, reducing the tension on string 24.

Figure 7:
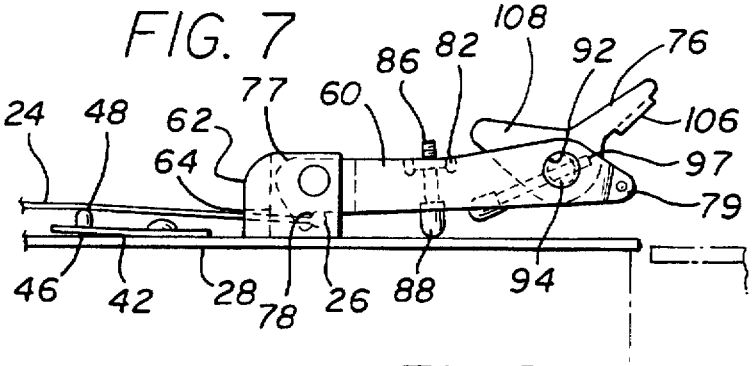
FIG. 7 is a side view of the armature placed in a third fixed position.

Further rotational manipulation of the handle 106 to rotate the lever arm 76 will bring both the nose portion 108 and the glide cap 98 of tuning screw 96 out of engagement with the bridge plate 28, to the position shown in FIG. 7. In this position, the second tuning screw 86 and the associated glide cap 88 directly contact the bridge plate 28, resulting in a third tension being placed on the associated string 24. Like the first tuning screw 96 described above, the second tuning screw 86 has a hexagonal socket 87 which can engage a hexagonal shaped wrench. The tuning screw 86 can be adjusted by threading it inwardly relative the tab 106 to vary the string tension.

It should be apparent to those skilled in the art that any change between the three positions described above will result in the string 24 being re-tuned from the same tensional direction. For example, when lever arm 76 is moved from the first position shown in FIG. 5 to the second position shown in FIG. 6, the tension of the string 24 is changed in tension decreasing direction. Similarly, when lever arm 76 is further moved from the second position shown in FIG. 6 to the third position of FIG. 7, the tension of string 24 will first increase, due to the longer length of tuning screw 96 than nose portion 108, then began to decrease until the third position of FIG. 7 is reached. Conversely, when the lever arm 76 is returned from the third position of FIG. 7 to the second position of FIG. 6, and ultimately back to the first position of FIG. 5, each of the new string tension positions will also be changed in a tension decreasing direction. This is a significant feature of the present invention, since it minimizes the affect of the frictional interaction between string 24 and the shelf 48, and results in more consistent tuning of the guitar. The frictional contact between the shelf 48 and the string 24 causes a "backlash" effect, which can affect the tuning of the string 24. By insuring that the string 24 always pulls in the same direction across shelf 48, the string will consistently reach the same final tension each time it is returned to the selected one of the three preset positions.

Referring now to FIG. 10, there is shown an acoustic guitar 120, featuring a multi-tuner bridge of the present invention. The acoustic guitar 120 comprises a neck 12 similar to the neck of the electric guitar 10 described above, but instead features a hollow body 116. The body 116 has a soundboard 122 which forms the front surface of the guitar 120. Generally centered within the soundboard 122 is a sound hole 126. As commonly known in the art, the interior portion of the body 116 forms a resonant cavity which acts to amplify the sound produced by the vibrating strings 24. Thus, it should be apparent that vibration of the soundboard 122 is critical to the quality of the sound produced by the guitar, and that the mounting of the multi-tuner bridge of the present invention must not interfere with its vibration.

Thus, to incorporate the multi-tuner bridge 30 with an acoustic guitar 120, the bridge plate 28 must be mounted to the guitar independently of the soundboard 122. As shown in FIGS. 11 and 12, the bridge plate 28 is secured to a bridge mounting block 128 which is provided substantially interiorly of the guitar 120. A hole 124 must be cut through the soundboard 122 of the guitar, with the bridge plate 28 extending through the hole but not touching the soundboard 122. It should be apparent that the soundboard 122 must be independent of the bridge plate 28, otherwise an undesirable buzzing or muting of resonance will sound as the soundboard vibrates. The bridge mounting block is secured to a pair of support members 134 and 134' by use of bolts 138 and 138', and to the bottom end 118 of the guitar body 116. At the other end of the guitar body 116, a neck block 132 is provided. The neck block 132 secures to the neck 12 and to the support members 134 and 134' by use of bolts 136 and 136'. It is anticipated that the neck block 132 be either integrally formed with an end of the neck 12, or be independent from the neck.

In FIG. 11, the support members 134 and 134' are shown to be a pair of I-beam supports, however, it should be apparent to those skilled in the art that one or more rigid, non-compressible members of alternative materials, such as metal, wood or plastic can adequately perform the same purpose. It should be further appreciated that alternative mounting techniques, such as screws or glue, can adequately serve the purpose of the exemplary bolts 138 and 136.

To further secure the bridge mounting block 128, a truss rod 144 is provided. The truss rod 144 has a forward connection bolt 148, which engages a forward hole 152 in the neck block 132, and a rearward connection bolt 154, which engages a rearward rod hole 156 placed in the bridge mounting block 128. A turnbuckle 146 joins the forward and rearward halves of the truss rod 144, as commonly known in the art. Turning the turnbuckle 146 results in increased tension on the guitar body 116 to counteract the increased tension of the strings 24.

It should be readily apparent to those skilled in the art that the internal strengthening of the guitar body 116 as described above has significant advantages. First, the problem of cabinet drop is effectively eliminated since the guitar body 116 will not be flexing under the increased string tension. Second, the soundboard 122 will not be absorbing any string tension load, and can be attached to the guitar body 116 with lighter internal bracing. The reduced bracing will enable the soundboard 122 to vibrate more freely, thus improving the sound quality of the instrument. Lastly, alternative string tension devices, such as tremolos, can be secured to the bridge plate 28, providing a capability to the acoustic guitar which would not have been possible before.

Having thus described a preferred embodiment of a multi-tuner bridge for a stringed musical instrument, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. Accordingly, the invention is defined by the following claims:

What is claimed is:

1. A bridge device in combination with a stringed musical instrument, said instrument having a neck, a plurality of strings each including an end portion, and a hollow body including a soundboard, the device comprising:

a mounting surface disposed in the hollow body of said instrument;

an opening in said soundboard having an opening disposed above said mounting surface; and a string engaging means secured to said mounting surface for anchoring said end portion to said mounting surface for carrying the tensioning of said strings;

said mounting surface rigidly connected to said neck independently of said soundboard;

wherein a force associated with tension of the strings of said instrument is transferred to said neck through said rigidly connected mounting surface rather than through said soundboard;

a mounting block wherein said mounting surface is disposed on the mounting block;

a forward block disposed in said hollow body;

a support member rigidly connecting said forward block and said mounting block;

said forward block contacting said neck;

wherein said rigid connection is formed by said forward block, said mounting block, and said support member; and an adjusting means interconnecting said forward block and said mounting block for increasing the rigidity of said rigid connection.

2. The device of claim 1, wherein said adjusting means comprises a truss rod having a forward end connected to said forward block and a rearward end connected to said mounting block, said forward and rearward ends being joined together by an adjustable turnbuckle for increasing tension on the guitar body to counteract increased tension on the guitar strings.

* * * * *